US005911472A

United States Patent [19]

Toth

[11] Patent Number: 5,911,472

[45] Date of Patent: Jun. 15, 1999

[54] ARMREST CONSTRUCTION FOR SOFAS

[76] Inventor: Travis P. Toth, 3325 S. 5th Ave. #62, Whitehall, Pa. 18052

[21] Appl. No.: 09/143,804

[22] Filed: Aug. 31, 1998

[51] Int. Cl.[6] ..... A47C 7/54

[52] U.S. Cl. ..... 297/188.2; 297/188.14; 297/411.24

[58] Field of Search ..... 297/188.1, 188.2, 297/188.14, 411.24, 452.38

[56] References Cited

U.S. PATENT DOCUMENTS

| | | | |
|---|---|---|---|
| D. 161,211 | 12/1950 | Saccoccia | 297/188.14 X |
| 909,453 | 1/1909 | Pullman | 297/188.14 |
| 1,019,658 | 3/1912 | King . | |
| 1,890,102 | 12/1932 | Urquhart . | |
| 2,524,659 | 10/1950 | Gorman | 297/411.24 |
| 2,638,971 | 5/1953 | Furman | 297/452.38 X |
| 2,668,582 | 2/1954 | Goodfellow | 297/411.24 |
| 2,704,114 | 3/1955 | Williams | 297/411.24 X |
| 3,922,973 | 12/1975 | Sturgeon | 297/411.24 X |
| 4,022,502 | 5/1977 | Smith et al. | 297/414 |
| 4,719,764 | 1/1988 | Cook | 297/188.14 X |
| 5,195,709 | 3/1993 | Yasushi | 297/188.14 X |
| 5,429,416 | 7/1995 | Lofy | 297/411.23 |
| 5,511,755 | 4/1996 | Spykerman | 297/188.14 X |

*Primary Examiner*—Peter R. Brown
*Attorney, Agent, or Firm*—Henderson & Sturm

[57] ABSTRACT

An armrest construction (10) for sofas (100) having a cushioned sofa back (101) and a plurality of seat cushions (102) wherein the construction (10) includes a rectangular block of cushion material (20) encased by a fabric cover unit (12) and provided with a hinged tail panel that is captively engaged between a seat cushion (102) and the sofa back (101); and wherein the top panel (31) of the cover unit (12) is provided with an aperture (31') aligned with a recess (22) in the block of cushion material (20) which is dimensioned to receive a receptacle insert (37).

2 Claims, 2 Drawing Sheets

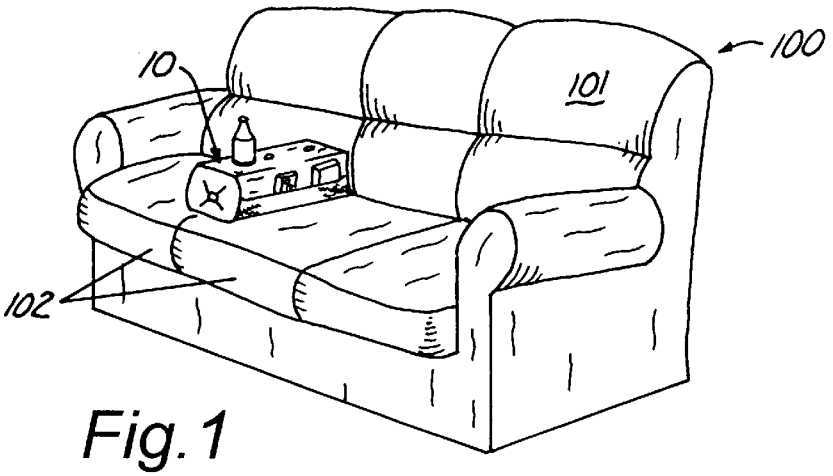
Fig. 1
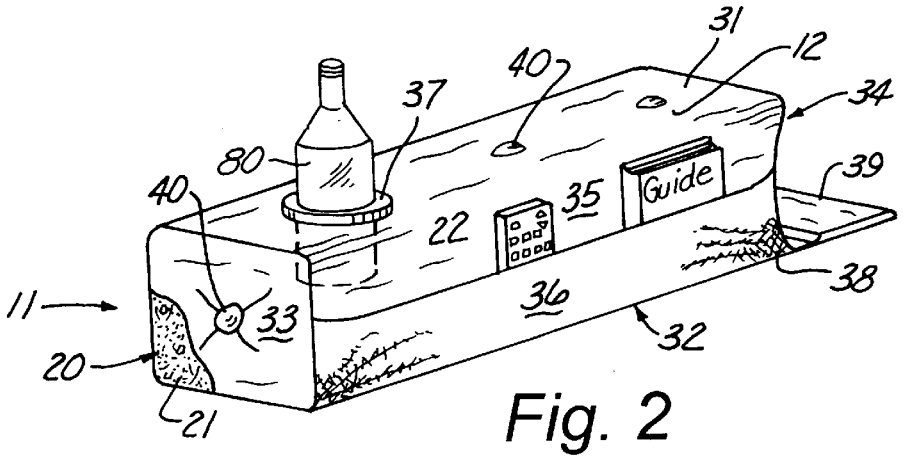
Fig. 2
Fig. 3
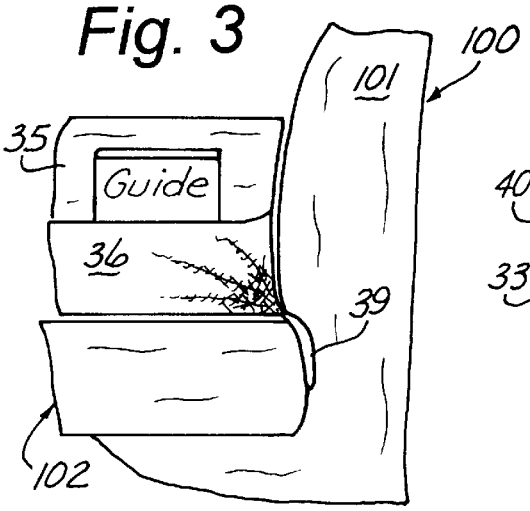
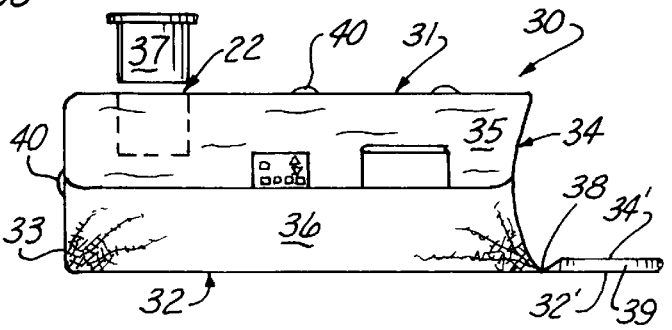
Fig. 4

ARMREST CONSTRUCTION FOR SOFAS

STATEMENT REGARDING FEDERALLY SPONSORED RESEARCH OR DEVELOPMENT

Not Applicable

CROSS-REFERENCE TO RELATED APPLICATIONS

Not Applicable

BACKGROUND OF THE INVENTION

1. Field of the Invention

The present invention relates to the field of armrest constructions in general and in particular to an armrest construction specifically designed for use on a sofa.

2. Description of the Related Art

As can be seen by reference to the following U.S. Pat. Nos. 5,429,416; 4,022,502; 1,019,658; and 1,890,102, the prior art is replete with myriad the diverse armrest construction for chairs, car seats and sofas.

While all of the aforementioned prior art constructions are more than adequate for the basic purpose and function for which they have been specifically designed, they are uniformly deficient with respect to their failure to provide a simple, efficient, and practical armrest construction that can quickly and easily be operatively attached and detached to a sofa and have a cover member that can be made from fabric that will match the fabric of the sofa so that the armrest construction has the appearance of being an integral part of the original sofa construction.

In addition the prior art constructions are further limited in only providing an armrest support function while ignoring other functional features that would enhance the use of the armrest.

As a consequence of the foregoing situation, there has existed a longstanding need for a new and improved type of armrest construction that not only matches the existing sofa but also includes a drink receptacle and one or more side pockets to store diverse articles such as television remotes, TV guides or the like.

BRIEF SUMMARY OF THE INVENTION

Briefly stated, the armrest construction that forms the basis of the present invention comprises in general an armrest body unit, a cover unit, and a unique method of attaching the cover unit and/or armrest body unit to the components of a sofa.

As will be explained in greater detail further on in the specification, the armrest body unit comprises a generally rectangular block of cushion material such as foam rubber or the like having an enlarged recess formed on its upper surface and dimensioned to receive a drink receptacle.

In addition, the cover unit comprises a cover member provided with a plurality of fabric panels which closely conform to the periphery of the armrest body unit; wherein the top panel is provided with an enlarged aperture dimensioned to receive a receptacle insert and at least one of the side panels is provided with an elongated pocket.

Furthermore, the cover unit and/or the armrest body unit is provided with a hinged tail panel that is used to releasably image the armrest construction between the components of a sofa.

BRIEF DESCRIPTION OF THE SEVERAL VIEWS OF THE DRAWINGS

FIG. 1 is a perspective view of the armrest construction operatively deployed on a sofa;

FIG. 2 is an isolated perspective view of the armrest construction;

FIG. 3 is a detail view of the engagement between the hinged tail panel and the sofa cushions;

FIG. 4 is a side plan view of the armrest construction;

DETAILED DESCRIPTION OF THE INVENTION

Figure 5:
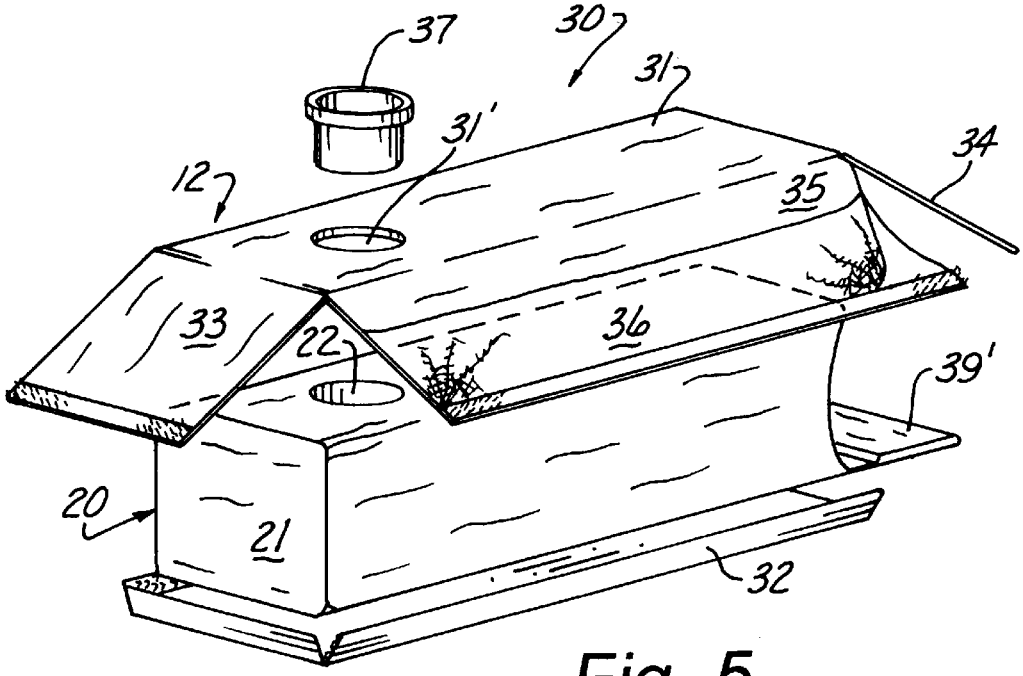
FIG. 5 is an exploded perspective view of an optional armrest cover unit.

As can be seen by reference to the drawings, and in particularly to FIG. 1, the armrest construction for sofas that forms the basis of the present invention is designated generally by the reference number (10). As shown in FIG. 2, the construction (10) comprises in general an armrest body unit (11) and a cover unit (12). These units will now be described in seriatim fashion.

As can best be seen by reference to FIGS. 2 and 4, the armrest body unit (11) comprises an elongated rectangular block (20) of foam cushion material (21) wherein the top surface of the block (20) is provided with an enlarged recess (22) depicted in phantom.

In addition as shown in FIGS. 2 and 4, the cover unit (12) comprises a fabric cover member (30) dimensioned to closely conform to the foam block (20) and having a top panel (31) a bottom panel (32), a front panel (33), a rear panel (34) and two opposed side panels (35) wherein at least one of the side panels (35) is provided with an elongated pocket (36) and the top panel (31) is provided with an enlarged aperture (31') which is aligned with the enlarged recess (22) in the foam block (20) and dimensioned to receive a plastic receptacle insert (37) that is dimensioned to retain a beverage container (80) in a well recognized fashion.

As can also be appreciated by reference to FIGS. 2 through 5, both the bottom panel (32) and the rear panel (34) are provided with extension flaps (34') and (32') which are connected together to form a flexible hinge (38) and captively engage a generally rigid tail panel (39) that is subsequently intended to be captively engaged between the cushioned sofa back (101) of a sofa (100) and a selected sofa cushion (102) to captively retain the armrest construction (10) relative to the sofa (100).

Returning once more to FIG. 2, it can be seen that both the front panel (33) and the top panel (31) of the cover member (30) can be provided with accessories such as buttons (40) or the like wherein the cover member (30) is fabricated from material that will closely resemble the fabric material that covers the sofa (100).

In an alternate version of the invention illustrated in FIG. 5, the foam block (20) is provided directly with a hinged tail panel (39') wherein the cover member (30) is fabricated as a two-piece member; wherein one piece includes the top (31), front (33), rear (34) and side (35) panels and at least one pocket element (36) and the second piece comprises the bottom panel (32) wherein the bottom panel (32) is joined to the other panels (33), (34), (35) by conventional fasteners (50).

Figure 6:
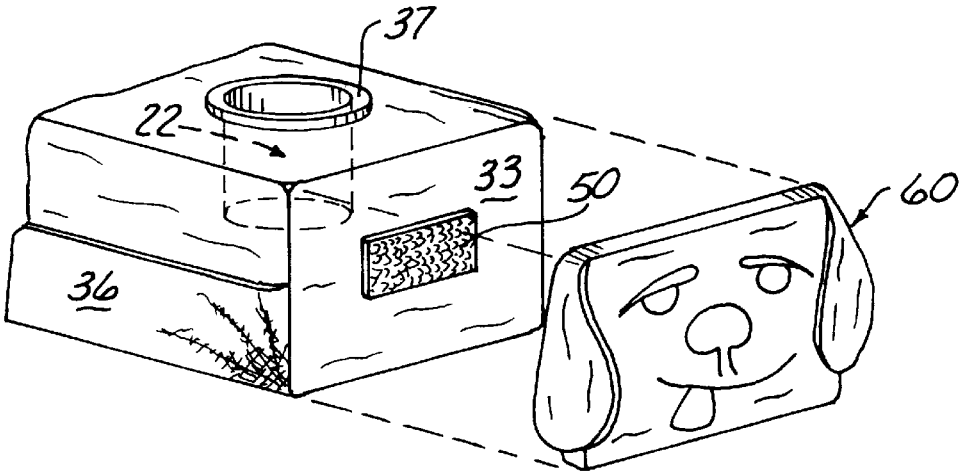
FIG. 6 is an exploded perspective view of an alternative version of the armrest construction.

In yet another alternate version of the preferred embodiment illustrated in FIG. 6, the front panel (33) of the cover member (30) is provided with a hook and loop fastener (50) that cooperates with a complimentary fastener on the rear surface of a decorative face panel (60) in the shape of an animal face caricature or the like.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. An armrest construction for sofas having a cushioned sofa back and a plurality of sofa seat cushions wherein the construction consists of:

an armrest body unit including an elongated rectangular block of cushion material having a top surface provided with at least one enlarged recess;

a fabric cover unit including a fabric cover member having a front panel, a top panel, and a pair of opposed side panels wherein at least one of the side panels is provided with an elongated pocket and the top panel is provided with an enlarged aperture which is aligned with said enlarged recess in said block of cushion material; wherein said enlarged aperture and recess are dimensioned to receive a receptacle; and, a generally rigid rectangular tail panel connected to the cover unit by a flexible fabric hinge wherein the rigid tail panel is dimensioned to be captively engaged between the sofa cushion back and a selected sofa seat cushion.

2. The construction as in claim 1; wherein the front panel of the cover member is provided with a removable decorative face panel.

* * * * *